US005704808A

United States Patent [19]

Chishima

[11] Patent Number: 5,704,808

[45] Date of Patent: Jan. 6, 1998

[54] SURFACE-MOUNT CONNECTOR

[75] Inventor: Masamitsu Chishima, Yokkaichi, Japan

[73] Assignee: Sumitomo Wiring Systems, Ltd., Yokkaichi, Japan

[21] Appl. No.: 678,942

[22] Filed: Jul. 11, 1996

Related U.S. Application Data

[63] Continuation of Ser. No. 304,180, Sep. 12, 1994, abandoned.

[30] Foreign Application Priority Data

Sep. 20, 1993 [JP] Japan ..... 5-055714 U

[51] Int. Cl.[6] ..... H01R 13/73

[52] U.S. Cl. ..... 439/571; 439/83

[58] Field of Search ..... 439/83, 569–572

[56] References Cited

U.S. PATENT DOCUMENTS

| | | | |
|---|---|---|---|
| 4,808,113 | 2/1989 | Kanesige et al. | 439/83 |
| 5,078,611 | 1/1992 | Tanigawa et al. | 439/83 |
| 5,078,622 | 1/1992 | Hunt, III et al. | 439/589 |
| 5,145,384 | 9/1992 | Asakawa et al. | 439/83 |
| 5,186,654 | 2/1993 | Enomoto et al. | 439/570 |
| 5,194,017 | 3/1993 | Consoli | 439/492 |
| 5,199,884 | 4/1993 | Kaufman et al. | 439/83 |
| 5,228,873 | 7/1993 | Hirai | 439/573 |
| 5,232,379 | 8/1993 | Lai | 439/570 |

FOREIGN PATENT DOCUMENTS

| | | | |
|---|---|---|---|
| 0 613 217 | 8/1994 | European Pat. Off. . | |
| 124740 | 5/1994 | Japan | 439/83 |
| 2 211 031 | 6/1989 | United Kingdom . | |
| 2 237 457 | 5/1991 | United Kingdom . | |

*Primary Examiner*—Gary F. Paumen

*Attorney, Agent, or Firm*—Oliff & Berridge, P.L.C.

[57] ABSTRACT

A fixing piece of a holder is inserted and fitted in a fixing hole in a housing, so that the fixing piece is embraced by a surrounding portion to be held in position. Therefore, positioning can be effected accurately, and the fixing force can be increased. No force will be exerted on other portions, and therefore, an intimate contact with a board can be maintained.

22 Claims, 3 Drawing Sheets

SURFACE-MOUNT CONNECTOR

This is a Continuation of application Ser. No. 08/304,180 filed Sep. 12, 1994, now abandoned.

BACKGROUND OF THE INVENTION

1. Field of the Invention

This invention relates to a surface-mount connector.

2. Description of the Related Art

One prior known surface connector of this type is shown in FIG. 6.

In this Figure, a housing 1 in the form of a generally flattened box has a plurality of connection terminal receiving holes la arranged in a transverse direction. A terminal 2 is inserted at one end portion in each connection terminal receiving hole 1*a*, and the other end portion of the terminal is projected from the housing 1 and bent toward the bottom of the housing. A pair of U-shaped grooves 1*b* are formed in the housing 1 at opposite side portions thereof and are disposed respectively on opposite sides of the group of connection terminal receiving holes 1*a*. The U-shaped groove is formed in three surfaces of the housing 1, that is, extending from an upper surface of the housing 1 to its bottom surface through its side surface. A U-shaped holder 3 is fitted in each of the grooves 1*b*. The holder 3 is exposed in surrounding relation to the housing 1 in such a manner that part of the holder 3 is received in the groove 1*b*.

In this construction, each of the terminals 2 is inserted at its one end portion into an associated connection terminal receiving hole 1*a* in the housing 1, and each of the holders 3 is slidingly fitted in a respective one of the grooves 1*b* in the outer surface of the housing. Thereafter, when the housing is placed on a predetermined portion of a board 4, the end portions of the terminals 2 projecting from the housing 1, as well as end portions of the holders 3, are contacted respectively with pads 5 formed on an upper surface of the board 4, as shown in FIG. 7, and the end portions are fixedly secured to the respective pads 5 by reflow soldering.

In the above conventional surface-mount connector, the housing is held by the U-shaped holders 3 fitted on the outer periphery of the housing 1. Thus, the housing is fittingly clamped by the holders, and therefore there has been encountered a problem that the housing can be easily disengaged from the holders.

If a retaining pawl for withdrawal prevention purposes is provided on the holder as shown in FIG. 8, the body of the holder 3 is deformed as shown in FIG. 9 when the holder is attached to the housing 1. As a result, the end surfaces of each holder 3 and the terminals 2 shown in FIG. 7 will not be disposed in a common plane, so that the thus lifted terminals can not be secured to the pads 5 by soldering. Furthermore, if the direction of insertion is slightly wrong when attaching the holder to the housing, the holder can be easily opened, so that the end surfaces are not disposed at a common level as in the above case, thus causing imperfect soldering.

SUMMARY OF THE INVENTION

The present invention has been made in view of the above problems, and an object of the invention is to provide a surface-mount connector in which holders are less liable to be withdrawn, and improper soldering of connection terminals is less liable to occur.

To achieve the above and other objects, there is provided a surface-mount connector including a housing holding connection terminals and holders that are fixed to the housing and securable by soldering to a mounting surface. The holder has a projected fixing piece, and the housing has fixing holes into which the fixing pieces of the holders can be inserted and fitted, respectively.

The fixing piece may be prevented from withdrawal from the fixing hole by convex and concave portions formed generally perpendicular to the direction of insertion of the fixing piece. The direction of insertion of the connection terminals into the housing is the same as the direction of insertion of the fixing piece into the fixing hole.

When the projected fixing piece of the holder is inserted into the fixing hole in the housing, they are fitted together. At this time, the fixing piece is forced into the fixing hole and is urged against an inner surface of the fixing hole; however, this urging force acts only on the fixing piece, and therefore other portions will not be deformed.

The convex and concave portions, disposed perpendicular to the direction of insertion, may be formed on the fixing piece and the fixing hole, and during the insertion, they cooperate with each other to prevent withdrawal. The convex and concave portions may be such that the convex portion at one of the fixing piece and the fixing hole forms the concave portion.

Since the direction of insertion of the connection terminals into the housing is the same as the direction of insertion of the fixing piece into the fixing hole, the connection terminals and the fixing pieces can be inserted in the same direction during assembling.

BRIEF DESCRIPTION OF THE DRAWINGS

The invention will now be described in detail with reference to the accompanying drawings, in which.

DETAILED DESCRIPTION OF PREFERRED EMBODIMENTS

Figure 1:
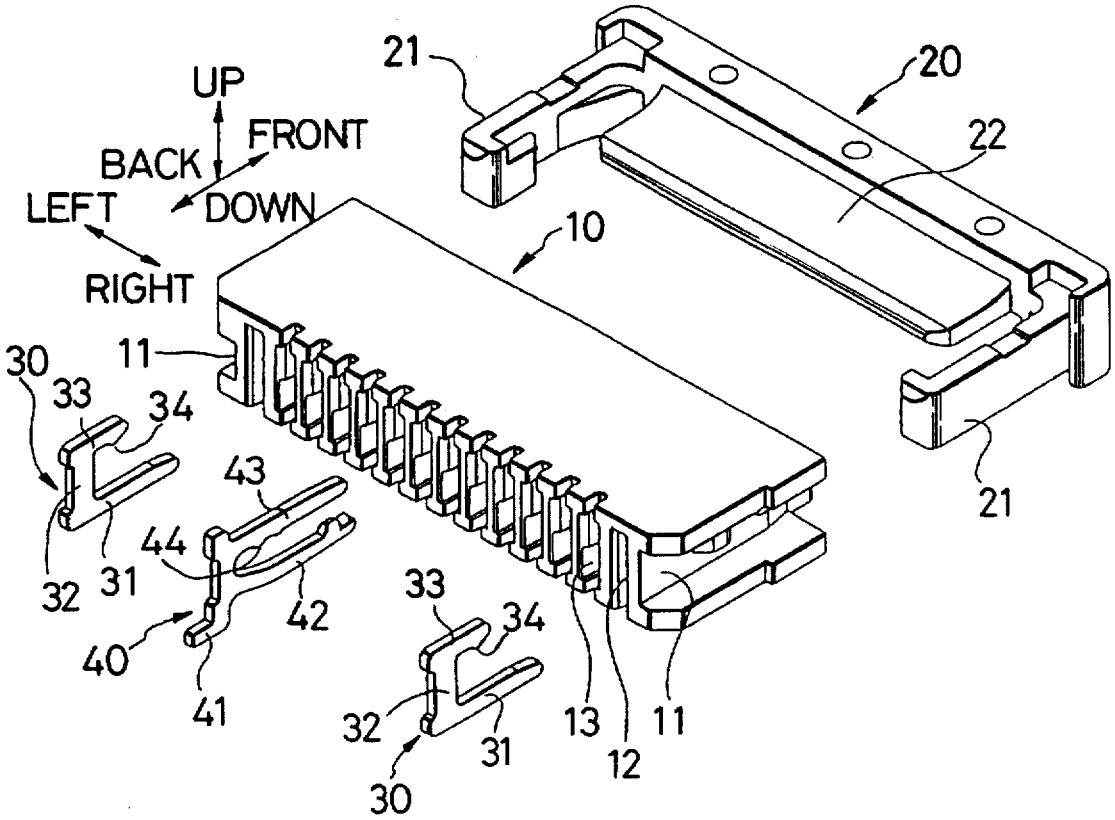
FIG. 1 is an exploded perspective view of one preferred embodiment of a surface-mount connector of the present invention.
Figure 2:
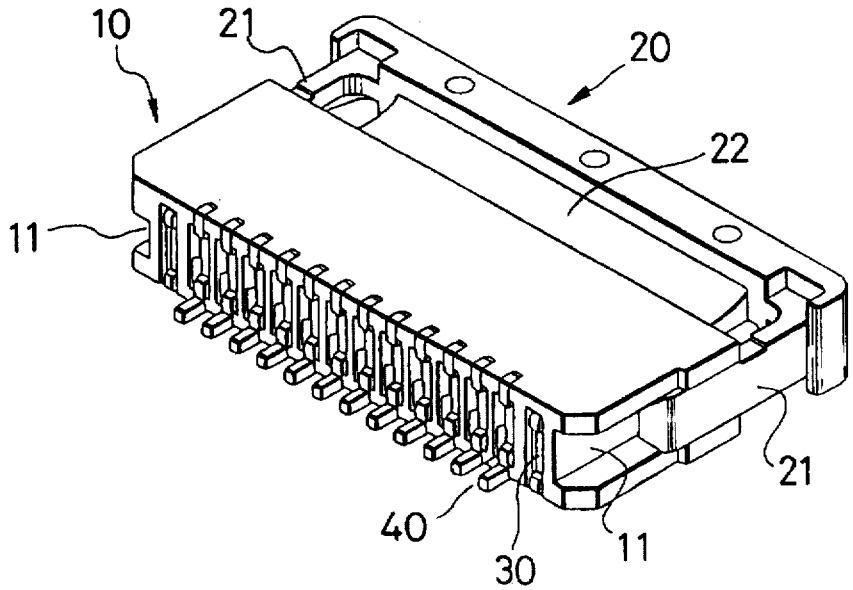
FIG. 2 is a perspective view of the surface-mount connector in its assembled condition.

FIG. 1 is an exploded, perspective view of one preferred embodiment of a surface-mount connector of the present invention, and FIG. 2 is a perspective view thereof in an assembled condition.

Figure 3:
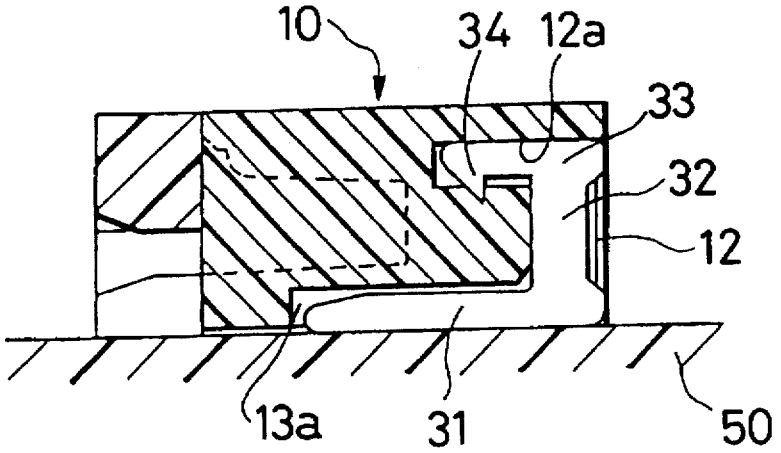
FIG. 3 is a cross-sectional view showing a holder receiving groove.

In these Figures, a housing 10 of a parallelepipedic shape is relatively thin in an upward-downward direction, and retaining recesses 11 and 11 for respectively retaining arms 21 and 21 of a retainer 20 are formed in opposite side surfaces of the housing. As shown in FIG. 3, holder receiving grooves 12 and 12 for respectively receiving holders 30 are formed in a rear surface of the housing 10 and are disposed inwardly of the retaining recesses 11 and 11, respectively. A plurality of connection terminal receiving holes 13, juxtaposed in a right-left direction, are formed between the two holder receiving grooves 12 and 12 and extend through the housing in a forward-backward direction, each of these holes 13 being adapted to receive and hold a terminal 40, as shown in FIG. 4.

As shown in FIG. 3, the holder 30 includes a lead portion 31 extending in the forward-backward direction to contact a surface of a board 50, a joint portion 32 extending upwardly from a rear end of the lead portion 31, and a fixing piece 33 extending forwardly horizontally from an upper end of the joint portion 32, the fixing piece 33 having a retaining projection 34 formed on a lower surface at a front end portion thereof. The holder receiving groove 12, formed in the housing 10, is open to the rear surface and lower surface of the housing 10 to provide a groove-like portion in which the lead portion 31 and joint portion 32 of the holder 30 can be received. A fixing hole 12*a* for receiving the fixing piece 33 of the holder 30 extends forwardly from an upper end of this groove-like portion, and the fixing hole 12*a* is of such a size that the retaining projection 34 on the lower surface of the fixing piece 33 engages a lower portion of an inner surface of the fixing hole 12*a* when the fixing piece 33 is inserted into the fixing hole 12*a*.

Figure 4:
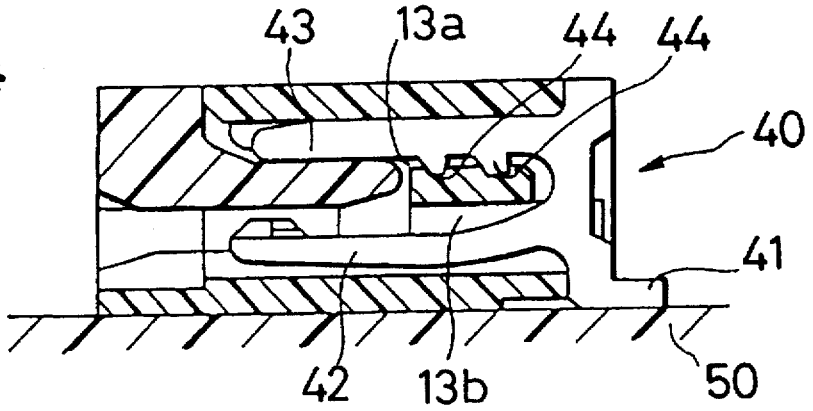
FIG. 4 is a cross-sectional view showing a connection terminal receiving hole.

As shown in FIG. 4, the terminal 40 includes a terminal portion 41 projecting from the connection terminal receiving hole 13 in the housing 10 for intimate contact with the surface of the board 50, and a pair of upper and lower pieces, that is, a terminal piece 42 and a positioning piece 43, extending forwardly from the terminal portion 41. The lower terminal piece 42 and the upper positioning piece 43 extend generally parallel to each other, and an inlet portion of the connection terminal receiving hole 13 is defined by one hole, and an inner portion of the receiving hole 13 is divided into an upper hole (i.e., a positioning hole 13*a*) for receiving the positioning piece 43 and a lower hole (i.e., a terminal chamber 13*b*) for receiving the terminal piece 42. Retaining projections 44 are formed on a lower surface of the positioning piece 43 at a proximal end portion thereof and are retainingly engaged with a lower portion of an inner surface of the positioning hole 13*a* when the terminal is inserted into the connection terminal receiving hole.

The retainer 20 includes retaining arms 21 and 21 and a retainer piece 22 adapted to be inserted into the connection terminal receiving holes 13 from the front side of the housing 10. The retainer piece 22 serves to prevent the withdrawal of the terminals 40.

The operation of the above construction will now be described.

The holders 30 and the terminals 40 are inserted into the respective holder receiving grooves 12 and the respective connection terminal receiving holes 13 from the rear side of the housing 10. At this time, the fixing piece 33 of the holder 30 is inserted into the fixing hole 12*a* of the holder receiving groove 12 while the joint portion 32 and the lead portion 31 are inserted into the groove-like portion. Because of the provision of the retaining projection 34 on the lower surface of the fixing piece 33, the upper surface of the fixing piece 33 is urged against the upper portion of the inner surface of the fixing hole 12*a* while the tip of the retaining projection 34 is urged against the bottom portion of the inner surface of the fixing hole 12*a*, and during the insertion, the tip of the retaining projection 34 is subjected to a high contact pressure and engages the housing 10. This pressure acts to compress the fixing piece 33 in the upward-downward direction, but this force will not act on the joint portion 32 and the lead portion 31 and therefore will not deform the joint portion 32 and the lead portion 31.

Since the upper surface of the fixing piece 33 is urged against the upper portion of the inner surface of the fixing hole 12*a*, they are intimately contacted with each other, and therefore, the holder 30 is accurately positioned relative to the housing 10, using the fixing hole 12*a* as a reference. The position of the fixing piece 33 and the upper portion of the inner surface of the fixing hole 12*a* affects the height and angle of the lead portion 31. By accurately positioning the two relative to each other, the lead portion 31 can be intimately contacted with the board 50 when the housing is mounted on the board, and the housing 10 can be held parallel to the board.

The positioning piece 43 of the terminal 40 is inserted into the positioning hole 13*a* of the connection terminal receiving hole 13 while the terminal piece 42 is inserted into the terminal chamber 13*b*. Since the retaining projections 44 are formed on the lower surface of the positioning piece 43, the projections 44 are urged into biting engagement with the bottom portion of the inner surface of the positioning hole 13*a* as described above for the retaining projection 34 of the holder 30, while the upper surface of the positioning piece 43 is urged into intimate contact with the upper portion of the inner surface of the positioning hole 13*a*. As a result, the terminal portion 41, projected from the connection terminal receiving hole 13, is properly positioned with respect to the housing 10. At this time, the lowermost surface of the terminal portion 41 is disposed at the same level as that of the lower surface of the lead portion 31 of the holder 30, and therefore, no gap is formed with respect to these portions when the housing 10 is placed on the board 50.

Thereafter, the retainer piece 22 of the retainer 20 is inserted into the connection terminal receiving holes 13 from the front side of the housing 10, and the retainer is fixed to the housing by the retaining arms 21 engaged in the retaining recesses 11 formed respectively in the opposite side surfaces of the housing 10.

Thus, the fixing piece 33 of the holder 30 is inserted and fitted in the fixing hole 12*a* in the housing 10, so that the fixing piece 33 is embraced by the surrounding portion. Therefore, accurate positioning can be achieved, and an increased fixing force can be obtained. Because no force will be exerted on other portions, the intimate contact with the board 50 can be achieved.

In the above embodiment, the position of the fixing piece 33 of the holder 30 (which is inserted into the fixing hole 12*a*) relative to the upper surface of the housing 10 is at the same level as the position of the positioning piece 43 of the terminal 40 (which is inserted into the positioning hole 13*a*) relative to the upper surface of the housing 10, and therefore, the insertion can be automatically and easily effected using, for example, a machine.

Figure 5:
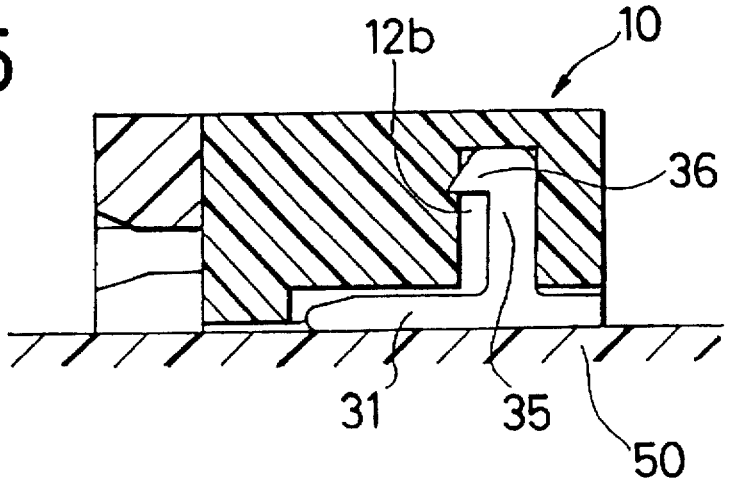
FIG. 5 is a cross-sectional view showing a holder receiving groove in a modified form of the invention.
Figure 6:
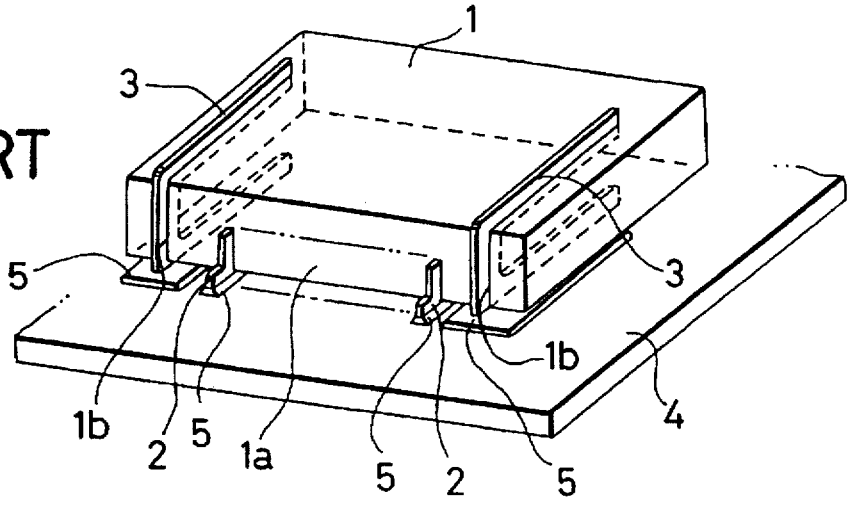
FIG. 6 PRIOR ART
FIG. 6 is a perspective view of a conventional surface-mount connector.
Figure 7:
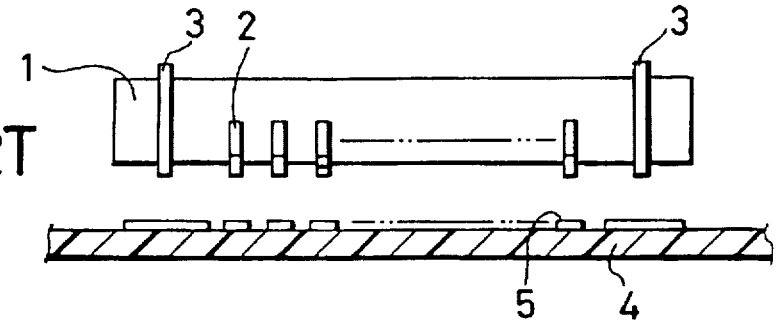
FIG. 7 PRIOR ART
FIG. 7 is a rear view of the conventional surface-mount connector.
Figure 8:
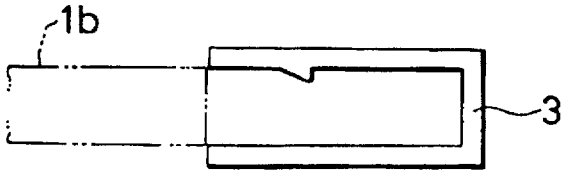
FIG. 8 PRIOR ART
FIG. 8 is a side-elevational view of an imaginary holder.
Figure 9:
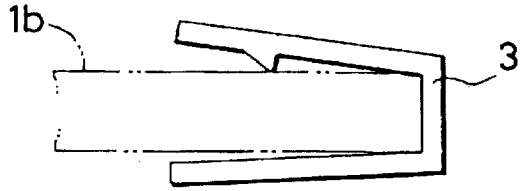
FIG. 9 PRIOR ART
FIG. 9 is a side-elevational view of the imaginary holder.

FIG. 5 shows another embodiment of the present invention.

In this embodiment, a holder 30 of a generally inverted T-shape includes a horizontal lead portion 31 and a fixing piece 35 extending vertically from the lead portion 31 at a point slightly offset from a central portion of the lead portion 31 toward a rear end thereof. Holder receiving grooves 12 each for receiving a respective one of the inverted T-shaped holders 30 are formed into an inverted T-shape. An upper end and a rear surface of the fixing piece 35 are formed straight, and an upper portion and a rear portion of an inner surface of the fixing hole 12b are formed straight. A retaining projection 36 is formed on a front surface of the fixing piece 35.

In this construction, the holder 30 is inserted into the holder receiving groove 12 from the lower side of the housing 10 such that the fixing piece 35 is inserted into the fixing hole 12b. At this time, the holder is stopped when the upper end of the fixing piece 35 is abutted against the upper portion of the inner surface of the fixing hole 12b. In this condition, the fixing piece 35 and the fixing hole 12b are intimately contacted with each other at their two sides disposed generally perpendicular to each other, and the positioning of the holder 30 relative to the housing 10 is effected accurately.

As described above, in the present invention, deformation at the area of contact between the holder and the housing will hardly affect other portions, and therefore, the fitting force can be enhanced without applying adverse effects to those portions for contact with a board, thereby providing a surface-mount connector in which the holders are less liable to be withdrawn.

In addition, the withdrawal prevention force can be enhanced by increasing the fixing force, and the efficiency of the assembling operation can be enhanced. Still further, the assembling accuracy can be enhanced by automation, and therefore, deformation during assembly can be prevented.

What is claimed is:

1. A surface-mount connector, comprising:

a housing holding connection terminals, said housing having a plurality of fixing holes extending in a forward direction from a rear side of said housing; and a plurality of holders that do not serve as connection terminals fixed to said housing, said holders being fixedly secured by soldering to a mounting surface, wherein said holders each comprise a lead portion, a joint portion and a projected fixing piece that are fully inserted into said housing from said rear side of said housing with said fixing pieces inserted into said fixing holes so that no part of either holder extends outside of said housing, and wherein said connection terminals are between said holders.

2. A surface-mount connector according to claim 1, wherein said fixing pieces are prevented from withdrawal from said fixing holes by convex and concave portions formed generally perpendicular to an insertion direction of said fixing pieces.

3. A surface-mount connector according to claim 2, wherein an insertion direction of said connection terminals into said housing is the same as the insertion direction of said fixing pieces into said fixing holes.

4. A surface-mount connector according to claim 2, wherein said convex and concave portions are formed on the fixing pieces and the fixing holes.

5. A surface-mount connector according to claim 4, wherein said convex portions form said concave portions.

6. A surface-mount connector according to claim 4, wherein said convex portions are retaining projections formed at ends of said fixing pieces, respectively.

7. A surface-mount connector according to claim 1, wherein an insertion direction of said connection terminals into said housing is the same as an insertion direction of said fixing pieces into said fixing holes.

8. A surface-mount connector according to claim 1, wherein each of said fixing pieces comprises a retaining projection at one end, said retaining projection engageable with said housing.

9. A surface-mount connector according to claim 1, wherein said holders further comprise lead portions extending substantially parallel to said fixing pieces, respectively, and wherein when said holders are fixed to said housing, said lead portions lie substantially flush with said mounting surface.

10. A surface-mount connector according to claim 1, wherein said holders further comprise lead portions extending substantially perpendicular to said fixing pieces, respectively, and wherein when said holders are fixed to said housing, said lead portions lie substantially flush with said mounting surface.

11. A surface-mount connector, comprising:

a housing having a plurality of connection terminal receiving holes for receiving a plurality of connection terminals, said housing further having a retaining recess and holder receiving grooves extending in a forward direction from a rear side of said housing;

a plurality of holders that do not act as connection terminals, said holders each comprising a lead portion, a joint portion and a projected fixing piece that are fully inserted into said holder receiving grooves from said rear side of said housing so that no part of either holder extends outside of said housing; and a retainer having a retaining arm engageable with said retaining recess, wherein said connection terminals are between said holders.

12. A surface-mount connector according to claim 11, wherein said holder receiving groove comprises a fixing hole, and said holder comprises a fixing piece insertable into said fixing hole.

13. A surface-mount connector according to claim 9, wherein said fixing piece is prevented from withdrawal from said fixing hole by convex and concave portions formed generally perpendicular go an insertion direction of said fixing piece.

14. A surface-mount connector according to claim 13, wherein an insertion direction of said connection terminals into said housing is the same as the insertion direction of said fixing pieces into said fixing holes.

15. A surface-mount connector according to claim 13, wherein said convex and concave portions are formed on the fixing piece and the fixing hole.

16. A surface-mount connector according to claim 15, wherein said convex portions form said concave portions.

17. A surface-mount connector according to claim 15, wherein said convex portion is a retaining projection formed at an end of said fixing piece.

18. A surface-mount connector according to claim 12, wherein an insertion direction of said connection terminals into said housing is the same as an insertion direction of said fixing piece into said fixing hole.

19. A surface-mount connector according to claim 12, wherein said fixing piece comprises a retaining projection at one end, said retaining projection engageable with said housing.

20. A surface-mount connector according to claim 12, wherein said holder further comprises a lead portion extending substantially parallel to said fixing piece, said lead portion engageable with said holder receiving groove, wherein when said holder is fixed to said housing, said lead portion lies substantially flush with said mounting surface.

21. A surface-mount connector according to claim 12, wherein said holder further comprises a lead portion extending substantially perpendicular to said fixing piece, said lead portion engageable with said holder receiving groove, wherein when said holder is fixed to said housing, said lead portion lies substantially flush with said mounting surface.

22. A surface-mount connector according to claim 1, wherein said holders further comprise lead portions, each lead portion having a length greater than a length of any other portion of said holder, and when said holders are fixed to said housing, each lead portion lies substantially flush with said mounting surface throughout said greater length.

* * * * *